US006039371A

United States Patent [19]

Smith

[11] Patent Number: 6,039,371

[45] Date of Patent: Mar. 21, 2000

[54] VACUUM STRETCHING AND GRIPPING TOOL AND METHOD FOR LAYING FLOORING

[76] Inventor: Mark Smith, P.O. Box 1091, San Andreas, Calif. 95249

[21] Appl. No.: 08/905,653

[22] Filed: Aug. 4, 1997

[51] Int. Cl.[7] ..... A47G 27/04; B25B 25/00

[52] U.S. Cl. ..... 294/8.6; 254/200

[58] Field of Search ..... 294/8.6, 64.1; 254/200, 201, 204–206, 209–212; 414/752

[56] References Cited

U.S. PATENT DOCUMENTS

| | | | |
|---|---|---|---|
| D. 126,411 | 4/1941 | Audette . | |
| D. 195,589 | 7/1963 | Charniga, Jr. . | |
| D. 199,333 | 10/1964 | Finley . | |
| D. 246,499 | 11/1977 | Poulsen et al. . | |
| D. 327,404 | 6/1992 | Le Cornec . | |
| D. 355,821 | 2/1995 | Kruskamp . | |
| 566,816 | 9/1896 | Taylor . | |
| 1,065,307 | 6/1913 | Evertts . | |
| 1,400,573 | 12/1921 | Stader | 294/64.1 |
| 1,757,529 | 5/1930 | Jones | 294/64.1 |
| 2,131,687 | 9/1938 | Kaplan . | |
| 2,212,755 | 8/1940 | Solomon . | |
| 2,394,265 | 2/1946 | Seamans . | |
| 2,420,811 | 5/1947 | Brewster et al. . | |
| 3,061,351 | 10/1962 | Johnson . | |
| 3,178,155 | 4/1965 | Bird . | |
| 3,180,604 | 4/1965 | Hammer . | |
| 3,219,377 | 11/1965 | Allen | 294/64.1 |
| 3,240,525 | 3/1966 | Wood . | |
| 3,659,678 | 5/1972 | Hall, Jr. . | |
| 3,770,259 | 11/1973 | Wagreich . | |
| 3,913,964 | 10/1975 | Lukeman . | |
| 4,091,945 | 5/1978 | Patterson . | |
| 4,214,785 | 7/1980 | Broch . | |
| 4,583,343 | 4/1986 | Camp | 294/64.1 |
| 5,042,772 | 8/1991 | Madjeski . | |
| 5,135,207 | 8/1992 | Bleaney . | |
| 5,184,858 | 2/1993 | Arai | 294/64.1 |
| 5,328,434 | 7/1994 | Carroll . | |
| 5,516,170 | 5/1996 | Kruskamp . | |
| 5,626,329 | 5/1997 | Herdan | 294/8.6 |
| 5,639,134 | 6/1997 | Rusch et al. | 294/64.1 |
| 5,894,705 | 4/1999 | Sutton . | |

FOREIGN PATENT DOCUMENTS

| | | |
|---|---|---|
| 0310396 | 9/1988 | European Pat. Off. . |

*Primary Examiner*—Dean J. Kramer
*Attorney, Agent, or Firm*—Bernhard Kreten

[57] ABSTRACT

A vacuum pump operated suction cup is utilized to form tools to assist the installer in laying flooring. In one embodiment, the suction cup is provided with a bracket which supports the vacuum pump and a handle having a knee pad at the end. In use, the suction cup is vacuum bonded to the flooring and pressed against the floor by hand while the knee pad is kicked with the knee to smooth out any irregularities. In another embodiment the flooring is stretched by pushing the vacuum bonded suction cup with a jack. In another embodiment, a tacking strip is utilized in lieu of adhesive to secure the flooring to a substrate with the assistance of the vacuum pump.

26 Claims, 7 Drawing Sheets

VACUUM STRETCHING AND GRIPPING TOOL AND METHOD FOR LAYING FLOORING

FIELD OF THE INVENTION

This invention relates to tools and their application to laying floor coverings configured as sheet goods.

BACKGROUND OF THE INVENTION

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention and as particularly claimed.

| PATENT NO. | U.S. PATENTS ISSUE DATE | INVENTOR |
|---|---|---|
| 1,065,307 | June 17, 1913 | Evertts |
| 2,394,265 | February 5, 1946 | Seamans |
| 2,420,811 | May 20, 1947 | Brewster, et al. |
| 3,061,351 | October 30, 1962 | Johnson |
| 3,178,155 | April 13, 1965 | Bird |
| 3,180,604 | April 27, 1965 | Hammer |
| 3,240,525 | March 15, 1966 | Wood |
| 3,659,678 | May 2, 1972 | Hall, Jr. |
| 3,770,259 | November 6, 1973 | Wagreich |
| 3,913,964 | October 21, 1975 | Lukeman |
| 4,214,785 | July 29, 1980 | Broch |
| 5,042,772 | August 27, 1991 | Madjeski |
| 5,135,207 | August 4, 1992 | Bleaney |
| Des. 355,821 | February 28, 1995 | Kruskamp |
| 5,516,170 | May 14, 1996 | Kruskamp |
| **PATENT NO.** | **FOREIGN PATENTS ISSUE DATE** | **INVENTOR** |
| EP 0310936 | September 29, 1988 | Maisch |

U.S. Pat. No. 5,516,170 discloses a vinyl and carpet kicker having interchangeable face plates so as to enable the tool to be used both in laying carpets and vinyl floor covering. When working with vinyl, a face plate is used having numerous small downwardly directed pyramidal knobs for frictional engagement with the vinyl surface. The knee kicker at the rear of the handle is provided with a wheel to reduce friction as the tool is moved along the vinyl surface. The disclosed tool can be used to smooth and to translate vinyl floor covering sheets subject to the coefficient of friction provided by the knobs. Once the frictional limitation of the device is met, this device is no longer useful. So that, if more stretching is required than this device can frictionally accommodate, necessary smoothing cannot be accomplished.

U.S. Pat. No. 5,135,207 discloses an apparatus to align a pair of panels such as found in counter-tops. A set of suction cups supported by parallel bars are secured by suction pressure to each panel on opposite sides of the separating gap. A set of lateral screws connects both sets of parallel bars and draws the panels together when tightened.

U.S. Pat. No. 3,240,525 discloses a vacuum device for handling various articles having smooth surfaces such as glass or metal sheets. A handhold is mounted on the pad to attach the pad to a load. A vacuum is created in the pad by means of a vacuum pump mounted within the handhold. A release valve at the end of the handhold can be operated to break the vacuum and release the load.

U.S. Pat. No. 3,178,155 discloses a carpet stretching tool having a foot piece engaging the carpet to stretch the carpet to engage the perimeter slats at the base of a wall. A toggle jack secured to the wall by a vacuum cup drives the foot piece.

U.S. Pat. No. 3,061,351 discloses a linoleum removal device wherein one or more static suction cups attached to a lifting handle can be secured to the smooth surface of a linoleum floor to pull it up section by section. The suction cup is provided with a valve which can be depressed to break the vacuum.

The other prior art listed above but not specifically described teach other devices employing suction pads or cups and further catalog the prior art of which the applicant is aware. These references diverge even more starkly from the references specifically distinguished above.

SUMMARY OF THE INVENTION

Installers of all types of floor covering know that the installation of vinyl or similar floor covering presents some unique and challenging problems which require special skills. The main problem arises from the need to employ a relatively quick setting adhesive to bond the flooring sheet to the floor, and the inability of any trapped air to bleed through the flooring. When the flooring sheet is cut and placed over the adhesive, air is trapped in certain locations forming ripples and blisters. The installer must then remove the surface anomalies by means of a roller or hand held wiping tool. The process is conducted in a hit or miss manner, leaving behind hidden air pockets which may lead to cracking and unsightly bumps. Many times, the prior art devices are simply incapable of correcting the anomalies due to their lack of sufficient frictional gripping means. This is especially true when such floor coverings are of a heavier commercial grade (21 mm or greater in thickness) and/or long areas, such as long hallways, need to be laid. This invention applies pump assisted vacuum technology to the problem of smoothing trapped air pockets, ripples, bubbles, or the like, and stretching flooring sheets when laying floor coverings.

This invention is directed to vacuum suction tools to aid the installer in smoothing and stretching sheet floor coverings so as to cause the flooring to lay smooth and flat on the base substrate. Floor coverings, as referred to in this application include but are not limited to, plastic, vinyl, linoleum, lamina, rubber or other coverings that might be gripped and stretched by suction means. For example, vinyl floor coverings are frequently applied to a prepared floor base by precutting and trimming a vinyl sheet to fit the area. An adhesive is then applied to the base floor and the precut vinyl sheet is laid over the adhesive. Vinyl, being less pliable and far less porous to air than, for instance, carpeting, is more difficult to lay flat, particularly over a tacky adhesive surface. Air bubbles and ripples form, which must be removed before the adhesive sets. This is especially difficult, if not previously impossible to overcome, when the vinyl has been distorted from shipping or being warehoused for a long period of time in a roll at the bottom of a pile of rolls and hence has become permanently deformed. Without the use of the present invention, these deformed rolls were unsalvageable. Installers employ rollers, vinyl kickers, rubber mallets, and an assortment of trade tricks learned from experience to smooth out any surface irregularities before the adhesive sets. However, if the anomaly is too severe, these old devices will not overcome the anomaly. In these cases, installers will many times return the flooring material to the supplier as "unusable". Not so, with the present invention. Testing has also shown the present invention to be of use in repairing preexisting floorings that have developed anomalies such as delamination or buckling.

In another method of laying vinyl floor covering, a specially prepared and rolled vinyl sheet is attached to the floor in a technique known as perimeter bonding. A three to six inch band of adhesive is applied around the perimeter of the room and the vinyl is unrolled, precut, and secured to the perimeter adhesive band while the medial portions are stretched and smoothed flat. While perimeter bonding achieves quicker set up and some installation simplifications, smoothing and stretching are still required and must be accomplished quickly. This vacuum gripping invention is designed to work in this time sensitive setting. Furthermore, the perimeter tacking invention also overcomes this gluing problem of the past when used in combination with the vacuum gripping invention.

This invention relies upon the principle of a vacuum suction in a tool to yield new features useful for the installation of the above type of floor coverings. A vacuum pad or pads with a self-contained vacuum pump or pumps is employed as the operating head in a tool to work vinyl type floor coverings. In one embodiment, the vacuum pad is fitted with a handle and knee pad. By being able to adjust the strength of the vacuum in the vacuum pad by means of a vacuum pump, the gripping pressure between the vacuum pad and vinyl sheet can be adjusted to significant strengths as compared to prior art frictional devices. With a light vacuum, the invention can be operated by hand in a wiping mode to remove minor anomalies. With a deeper vacuum and stronger grip, the invention can be knee operated or mechanically forced, as with a jack-type device, to remove larger air pockets and both ripples and creases previously irreparable. By being able to adjust the vacuum strength, the invention can be utilized in many different ways to assist the installer. Clearly, a plurality of adjustably pumpable vacuumable pads may also be employed and those pumps could be manually operated or not.

In another application, the vacuum pad described above uses a toggle jack instead of a handle and kick pad. The toggle jack is mounted on an adjustable telescoping tube which is braced against an end wall while the front end of the jack abuts the vacuum pad. In use, when a large precut sheet of vinyl needs to be stretched across a room, the telescoping tube is adjusted as to length and braced against a wall. The front end of the tube is attached to the vacuum pad which is then evacuated for maximum suction. The toggle jack is then operated to stretch the vinyl sheet with respect to the wall. Because of the strong gripping action of the vacuum pad against the vinyl sheet, large and heavy sections of floor covering can be stretched in a manner not previously capable of being performed. Clearly, this jack could be driven by other than hand means, such as hydraulic, pneumatic, electrical, or like means.

In yet another application, the vacuum pad described above is used on a flooring that is coupleable to a substrate by means of a tack strip. This was neither known, nor possible, in the past. By tacking a beginning edge of a flooring sheet and gripping it with the vacuum pad described above and stretching and holding that flooring while tacking more edges down, a flooring may be laid without the use of adhesives, thereby reducing labor and material costs. Use of the tack strip as opposed to adhesives has a number of environmental benefits as well, such as, elimination of a flammable material, elimination of noxious odors, and elimination of a causal factor for sick building syndrome.

OBJECTS OF THE INVENTION

The overall object of the invention is to utilize vacuum suction means for smoothing and stretching flooring sheets when installing floor coverings.

It is a specific object of the invention to employ an adjustable pump-operated vacuum pad as the operating head of a flooring stretcher.

It is another object of the invention to adapt an adjustable pump-operated vacuum pad to a telescoping jack to stretch a flooring sheet with respect to an end wall.

It is another object of the invention to employ a lever operated toggle jack at the end of an adjustable tube braced against an end wall to manipulate an adjustable pump-operated vacuum pad in a flooring sheet stretching operation.

It is another object of the invention to equip an adjustable pump-operated vacuum pad with an adapter plate so as to be able to manipulate the pad with different drives.

It is another object of the invention to utilize the properties of an adjustable pump-operated vacuum pad in devising novel methods for installing floor coverings.

It is yet another object of the invention to utilize the properties of an adjustable pump-operated vacuum pad along with a perimeter tacking technique for smooth floorings.

Viewed from a first vantage point it is the object of the present invention to provide a tool for applying flooring configured as sheet goods, comprising in combination: a vacuum suction means overlying the flooring for evacuating air between the vacuum suction means and the flooring; an arm having first and second ends, the first end coupled to the vacuum suction means, extending substantially parallel to the flooring; a pad affixed to the second end whereby the flooring is conformably deployed by moving the flooring in a plane parallel in tangential registry to an underlying substrate by applying force through the pad also parallel to the substrate.

Viewed from a second vantage point it is the object of the present invention to provide a vacuum tool for stretching a floor covering coupleable to base flooring, comprising: a vacuum pump operated suction cup vacuum bonded to the covering; a bracket mounted on the suction cup; pusher plate secured to the bracket; jack mounted between the pusher plate and a reaction surface; and to extend the jack to move the suction cup and stretch the covering.

Viewed from a third vantage point it is the object of the present invention to provide a method of stretching a smooth floor covering over a substrate, the method comprising the steps of: coupling an end of the floor covering to the substrate; mounting a vacuum pump operated suction cup equipped with a pusher plate on a selected surface of the covering; evacuating the suction cup to effectively clamp the suction cup to the covering; mounting an extendible jack between the pusher plate and a stationary reaction surface; and extending the jack to move the suction cup and attached covering with respect to the reaction surface.

Viewed from a fourth vantage point it is the object of the present invention to provide a device for removing surface anomalies in sheet flooring comprising, in combination: suction means removably engageable to the sheet flooring; and means for urging the suction cup to smooth the anomalies.

Viewed from a fifth vantage point it is the object of the present invention to provide a method for removing surface anomalies in sheet flooring, the steps including: forming a vacuum between a tool and the flooring; and stretching the flooring.

Viewed from a sixth vantage point it is the object of the present invention to provide a tool for stretching flooring, comprising, in combination: a suction cup; means to activate and release the suction cup; and means to apply a force to the suction cup parallel to the floor.

Viewed from a seventh vantage point it is the object of the present invention to provide a method for installing flooring, the steps including: applying adhesive to a surface; cutting flooring to match the surface; laying the flooring on the surface; applying a vacuum to strategic areas of the flooring and stretching the flooring to smooth the flooring by kicking a kickpad on the vacuum.

These and other objects will be made manifest when considering the following detailed specification when taken in conjunction with the appended drawing figures.

DESCRIPTION OF PREFERRED EMBODIMENTS

Figure 1:
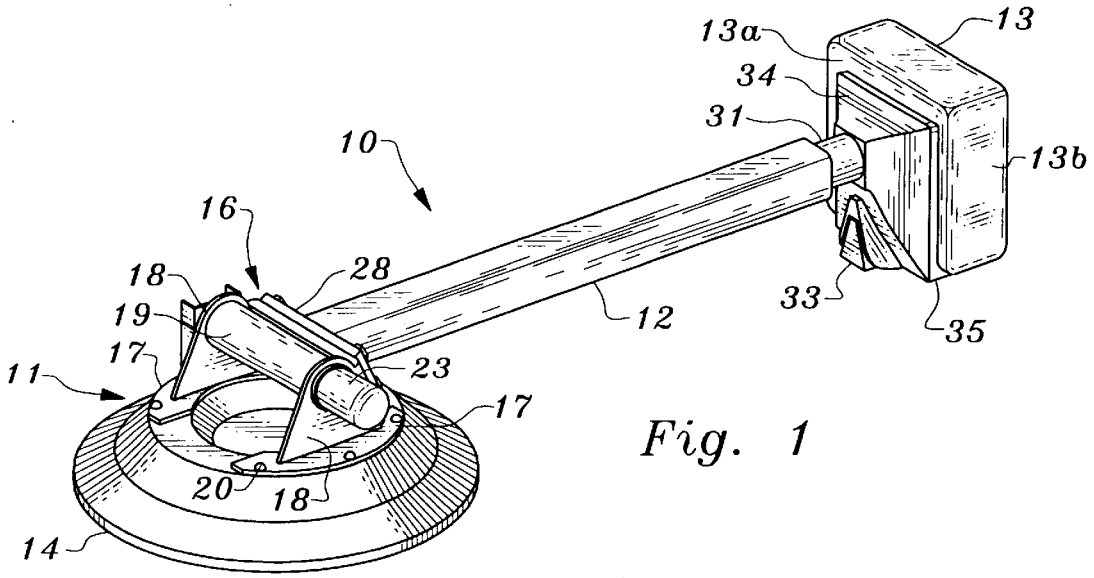
FIG. 1 is a perspective view of the novel flooring stretcher showing the vacuum pad at one end and the knee pad at the other end.
Figure 2:
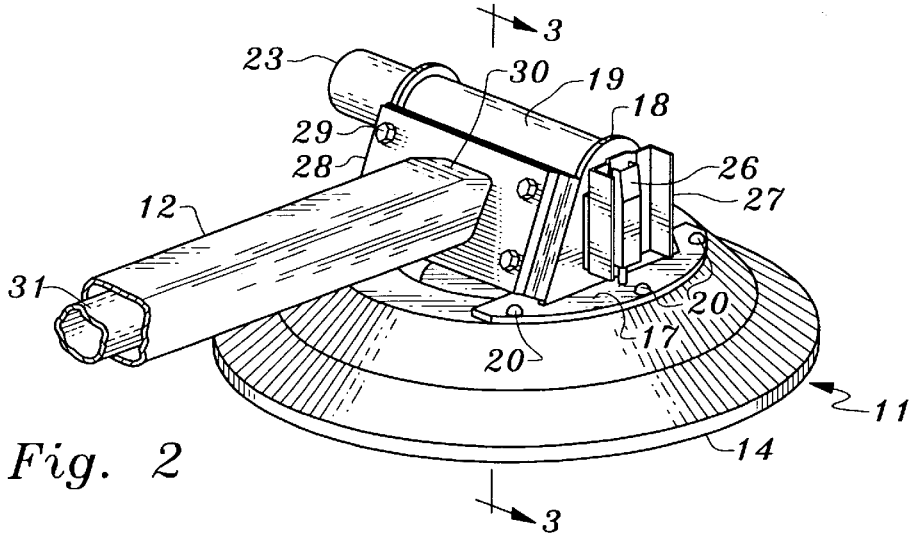
FIG. 2 is a perspective view of the vacuum pad rotated 180 degrees with respect to FIG. 1.
Figure 3:
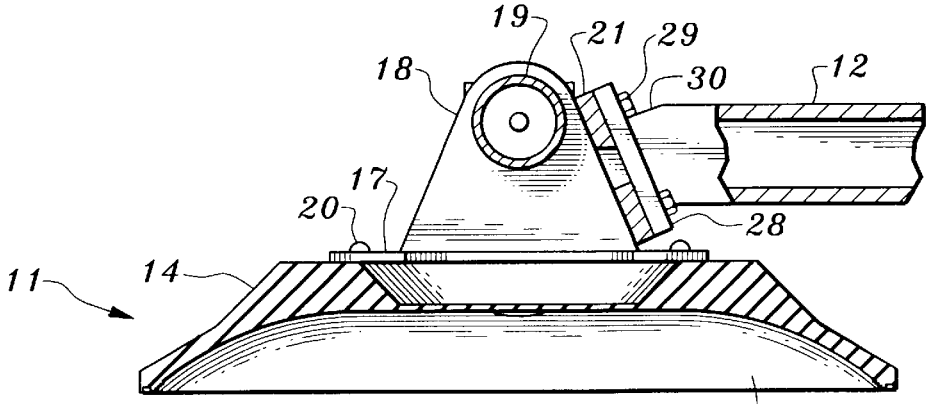
FIG. 3 is a cross sectional view of the vacuum pad taken along the line 3—3 of FIG. 2.
Figure 4:
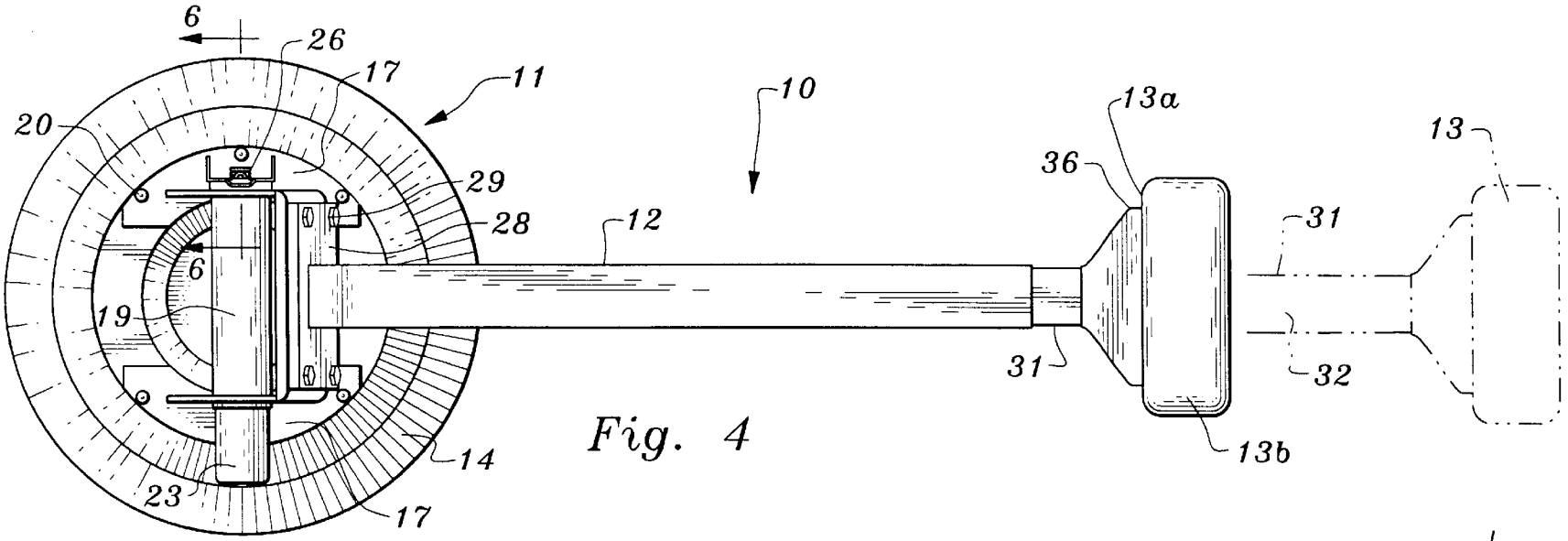
FIG. 4 is a top plan view of the flooring stretcher.
Figure 5:
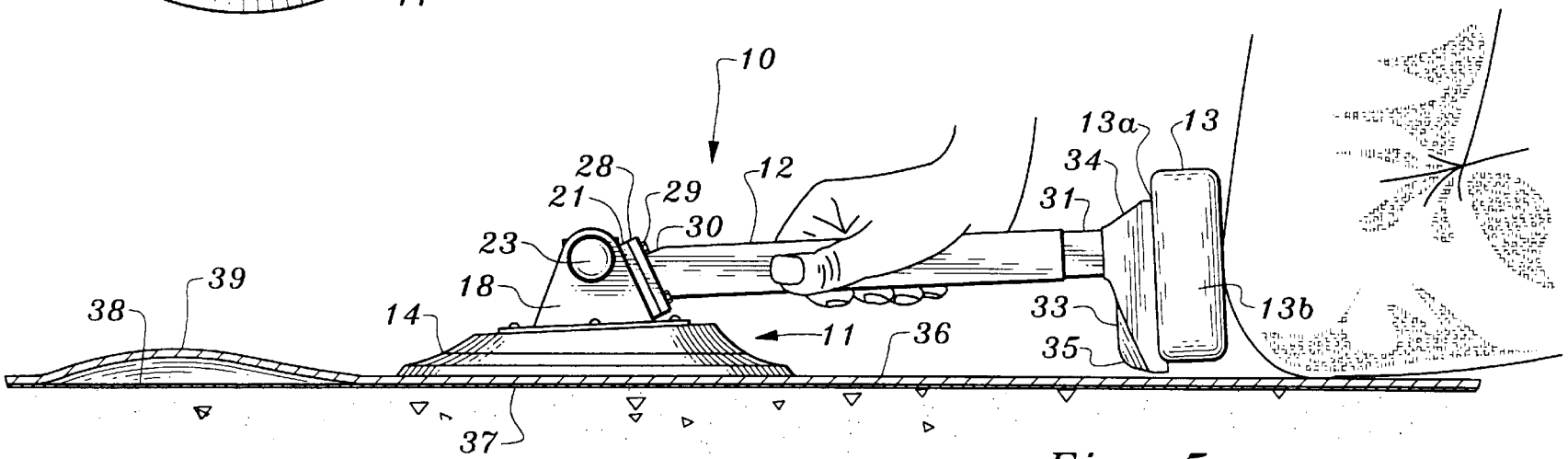
FIG. 5 is a side view of the novel flooring stretcher in operative position smoothing a flooring sheet.
Figure 6:
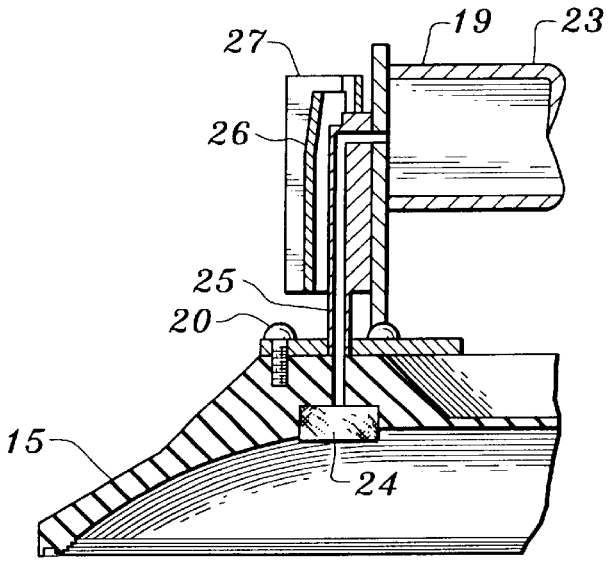
FIG. 6 is a part sectional view taken along lines 6—6 of FIG. 4 showing some details of the vacuum break valve.

Considering the drawings, wherein like reference numerals denote like parts throughout the various drawing figures, reference numeral 10 is directed to a flooring vacuum stretcher according to a first embodiment of the present invention. The vacuum stretcher is formed of three main components; a vacuum head 11, an adjustable handle 12, and a knee pad 13. The vacuum head 11 comprises a vacuum pad or suction cup 14 made of pliant rubber or any suitable elastomer having equivalent properties. An air space or chamber 15 is formed in the inverted suction cup 14 and when the air is evacuated, the suction cup 14 collapses by the action of atmospheric pressure and seals against a smooth surface as best shown in FIG. 5.

Figure 7:
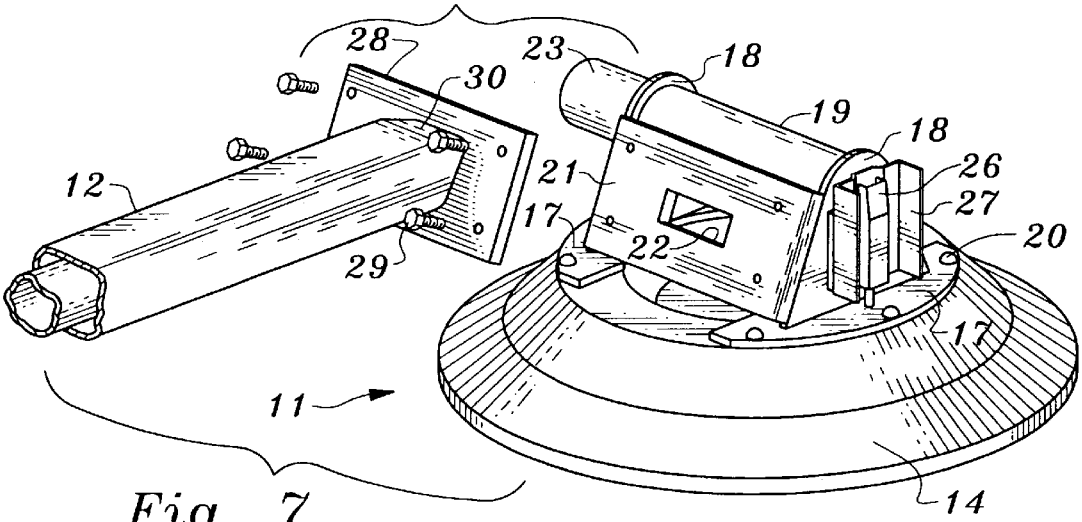
FIG. 7 is a perspective view showing the connection between the handle and vacuum pad.
Figure 8:
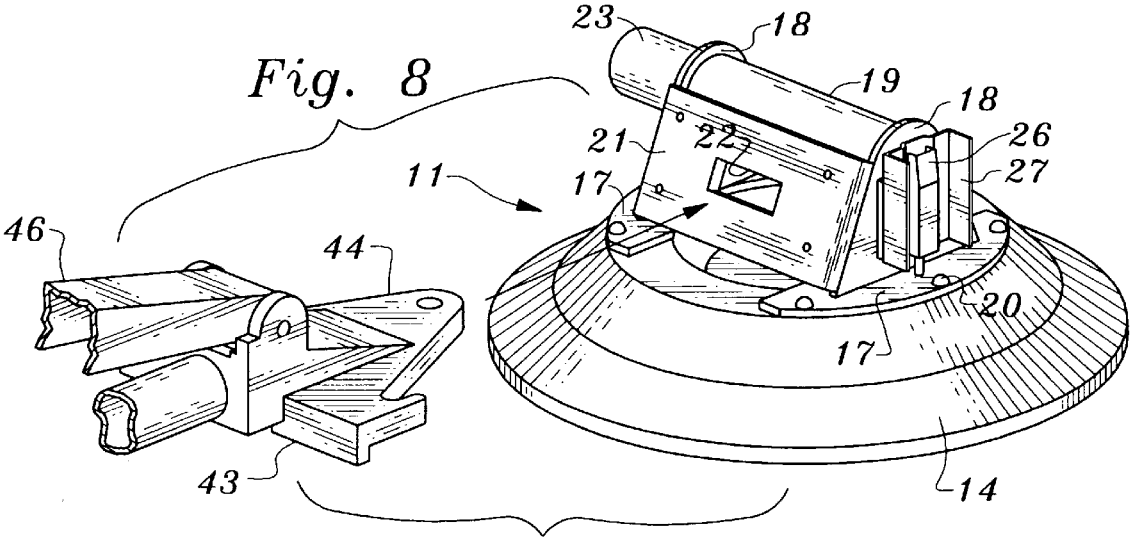
FIG. 8 is a perspective view showing the connection between the vacuum pad and a telescoping jack usable with the pad.
Figures 9, 10, 11:
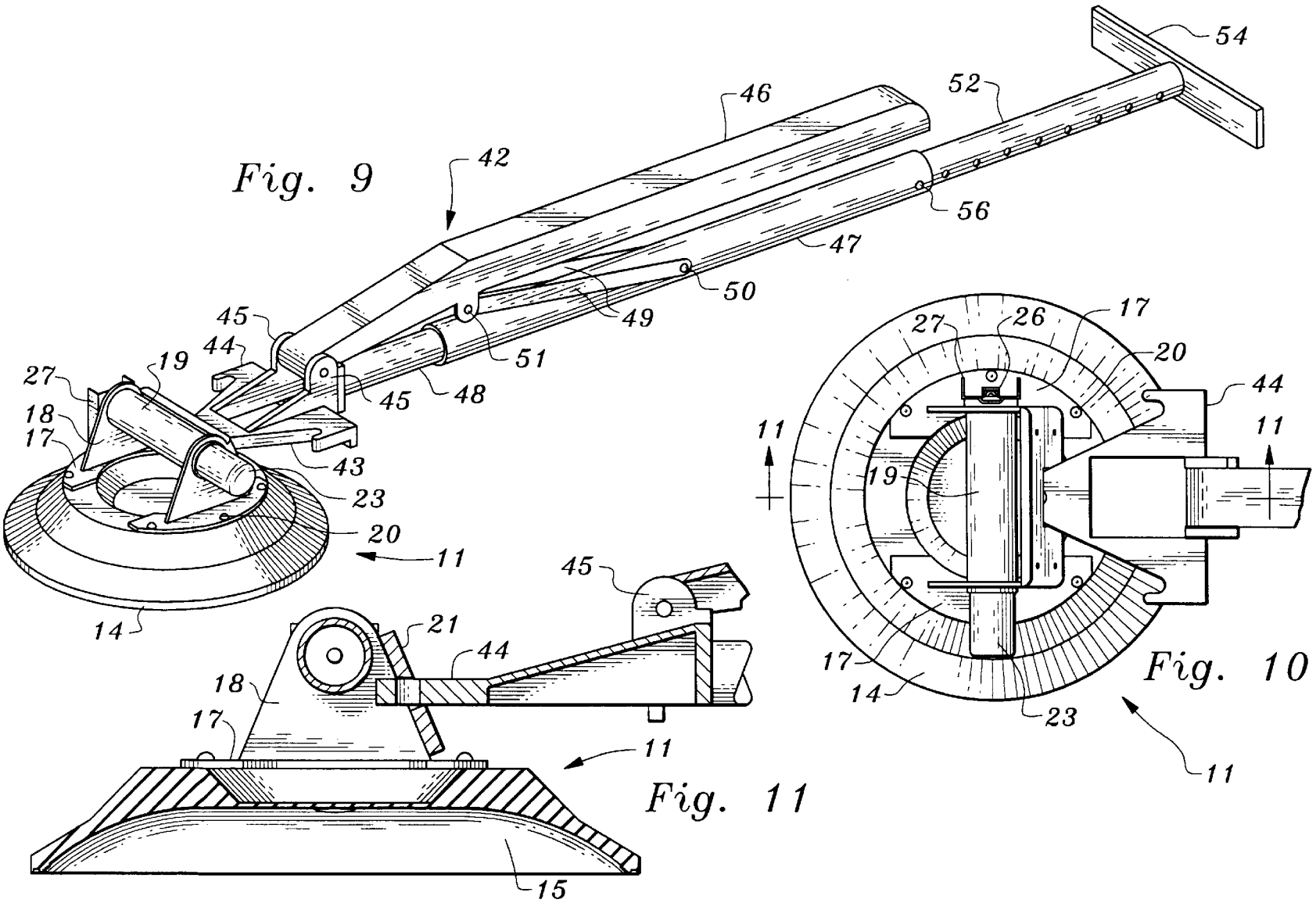
FIG. 9 is a perspective view of the vacuum pad combined with a telescoping jack.
FIG. 10 is a top plan view of the connection between the vacuum pad and telescoping jack.
FIG. 11 is a sectional view of the connection between the vacuum pad and the telescoping jack taken along lines 11—11 of FIG. 10.

A superstructure 16 formed of two spaced flanges 17 with upstanding angled ears 18 connected by a cross tube 19 is securely attached to the suction cup 14 by means of fasteners 20. As best shown in FIGS. 7 and 8, a mounting or pusher plate 21 having a rectangular opening 22 is secured to the angled ears 18 to lie at a small angle from the vertical. A piston 23 is manually reciprocated in cross tube 19 to draw air from chamber 15 through filter 24 up tube 25 to be exhausted to the atmosphere. A finger operated valve 26 protected by shield 27 can be operated to admit air into chamber 15 to break the vacuum.

Figure 14:
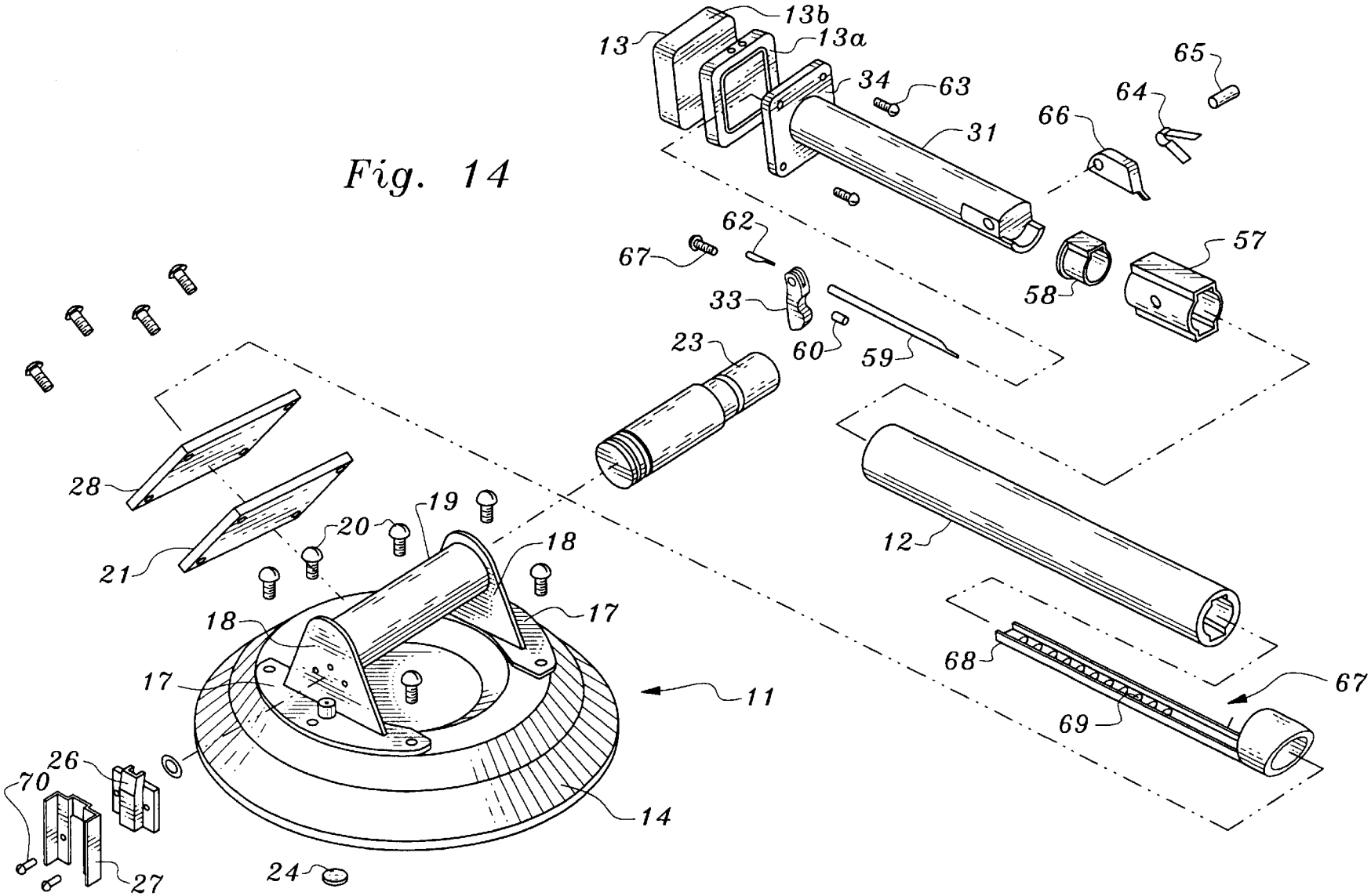
FIG. 14 is an exploded parts perspective of the flooring stretcher.
Figure 16:
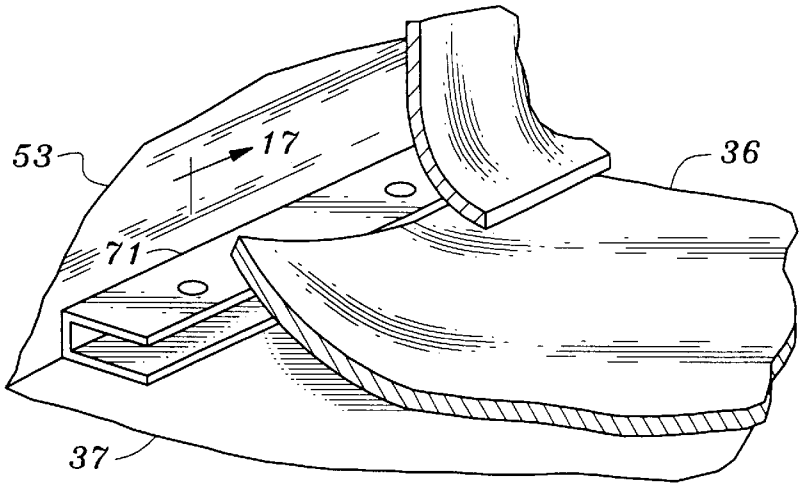
FIG. 16 is a view of the tacking strip receiving a flooring sheet along a wall.
Figure 17:
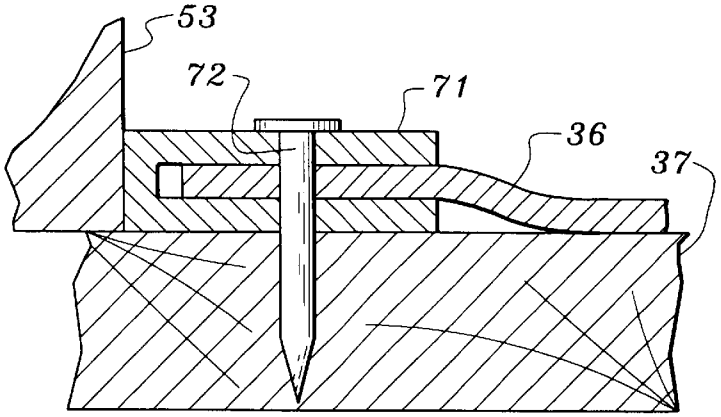
FIG. 17 is a part sectional view when taken along lines 17—17 of FIG. 16 showing flooring tacked to a substrate with the tacking strip.

FIGS. 1–7 show the vacuum stretcher embodiment of the invention wherein handle 12 is bolted to mounting plate 21 by means of a matching plate 28 and bolts 29. As can best be seen in FIG. 3, handle 12 joins plate 28 at an angle 30 so that force applied to the handle 12 acts on the vacuum head 11 in a downwardly and lateral direction. Handle 12 receives an extension tube 31 of a similar cross section but with just enough clearance to prevent wobbling. As depicted in FIG. 14, adjustment of extension 31 with respect to handle 12 is achieved by indexing pawl 66 with a spring urged button 33 to advance pawl 66 on track 68. This is accomplished by pulling the button 33 with an index finger which causes a rod butt 62, connected to an opposite end of button 33, to press into rod 59, which is housed within extension 31. Thereafter, rod 31 engages pawl 66 via bias means or spring 64. Both rod 59 and spring 64 are coupled together and to extension 31 by pin 65. Once pawl 66 is engaged by rod 31, pawl 66 can "walk" down track 68 to the next track step 69. It should be noted that, in order to collapse the flooring vacuum stretcher 10 from its extended position, the button 33 is held in, thereby holding the pawl 66 up and away from the track 68, and sliding the extension 31 and adjustable handle 12 back together. Adjustable handle 12 slides in minimal frictional communication over sleeve 57 until stopped by collar 58 abutting into support fixture 34.

The knee pad 13 is secured to the end of the extension tube 31 by means of a support fixture **13*b* and connected to extension tube end 34 having a bottom lip 35 with an outside plastic liner to slide over the flooring without marring. The knee pad 13 is foam filled, thereby defining a rectangular solid, and is provided with a durable circumscribing cover 13*b* and has a back plate 13*a* for connection to fixture 34**.

In use, as shown in FIG. 5, extension 31 is set for the desired length and button 33 is triggered to secure the extension in position. The vacuum stretcher is then placed on the flooring sheet 36 which has been laid on substrate 37 coated with a layer of adhesive 38. A ripple 39 is removed by pumping the piston 23 until the desired vacuum is obtained. The installer then grips the handle 12 and applies downward pressure while butting the knee pad 13 with his knee to wipe the suction cup 14 over the ripple 39 and press it out. For operation in a jacking mode, the vacuum head 11 would be placed forwardly of ripple 39 (FIG. 12) and the operation repeated. The ability to adjust the suction pressure as needed is an important advantage in this invention.

Figure 15:
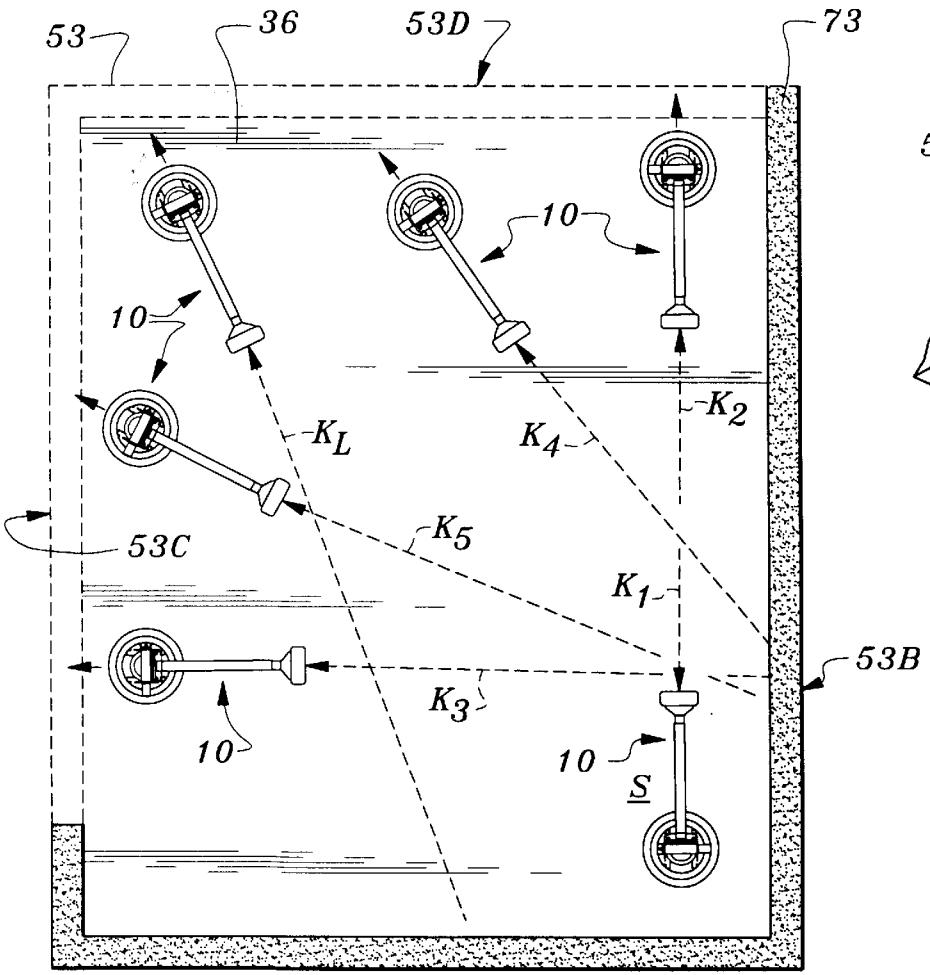
FIG. 15 is a schematic force diagram illustrating one wiping scheme to smooth out surface anomalies in laying a vinyl floor covering.

FIG. 15 is a force diagram showing one example of the use of the vacuum stretcher. The diagram shows a rectangular room. After the flooring 36 is precut and laid on the partially adhesively coated floor 73, the vacuum stretcher is placed on the lower right corner (53*a*/53*b*) and set for the suction pressure suitable for the area. Starting from a position S, the vacuum stretcher 10 stretches the flooring 36 toward the wall 53*a*. This is continued along wall 53*a* until the flooring 36 is in tangential registry with wall 53*a*. Once wall 53*a* is set, the same is accomplished along wall 53*b*. Thereafter, while gradually adding glue to the remaining perimeter, the vacuum stretcher will follow substantially a path along line $K_2$ to register the flooring 36 with wall 53*d* near wall 53*b*. The same is next accomplished toward wall 53*c* along path $K_3$ starting near wall 53*b*. Then, starting again near wall 53*b*, path $K_4$ is followed having two vectors of application (toward wall 53*c* and wall 53*d*), thereby following an arcuate pattern. Next, path $K_5$ is followed in a similar manner and other paths are likewise accomplished until the last path $K_L$ is followed. Path $K_L$ starts at wall 53*a* and again follows an arcuate path toward walls 53*d* and 53*c* (or the corner 53*d*/53*c*).

Alternatively, instead of using adhesive, due to the increased gripping capabilities of this invention, tack strip 71 may likewise be used. In that way, the tack strip is gradually secured to the floor 36 in tangential registry with the wall 53 as the vacuum stretching tool grips, stretches, and holds the flooring 36.

In a second embodiment of the invention illustrated in FIGS. 8–13, a toggle jack 42 is provided with a jack head 43 having a tapered drive 44 which is inserted in rectangular opening 22 in pusher plate 21. The jack head 43 has a pair of upstanding ears 45 which pivotally supports a jack handle 46.

Figure 12:
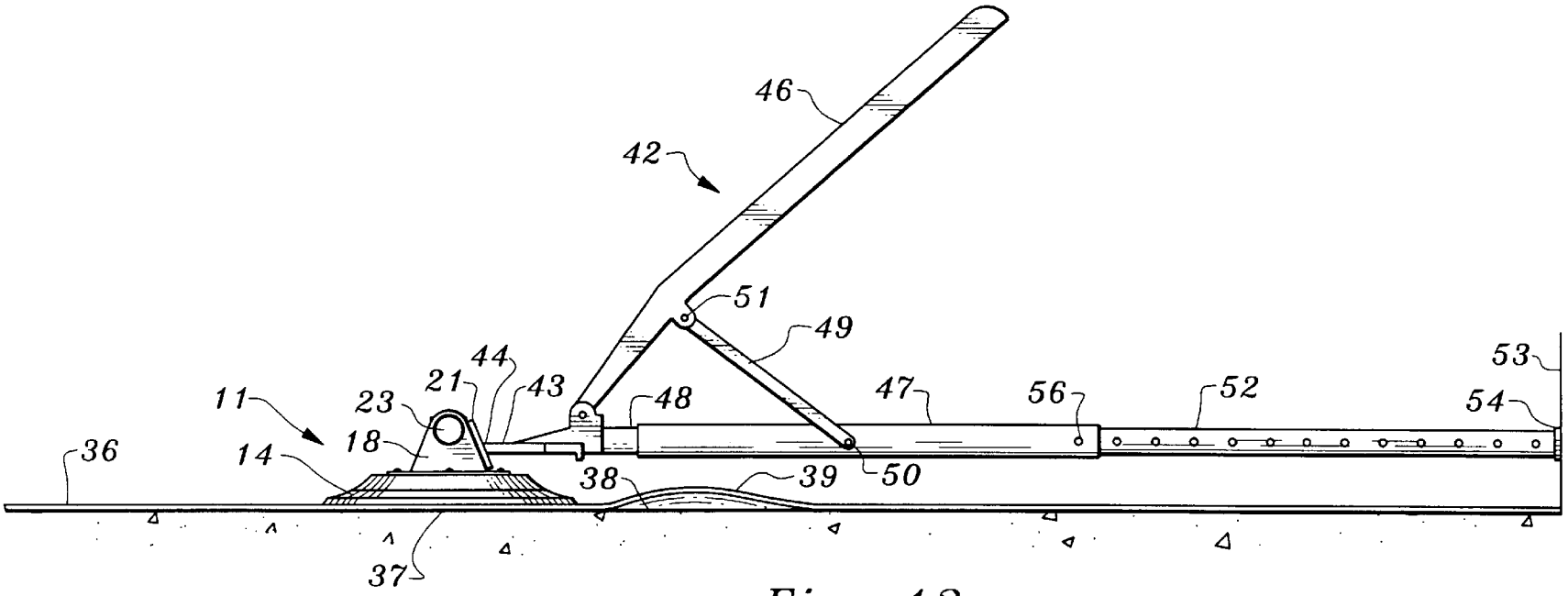
FIG. 12 is a view of the vacuum pad and telescoping jack in a position to stretch a flooring sheet having a slack portion.
Figure 13:
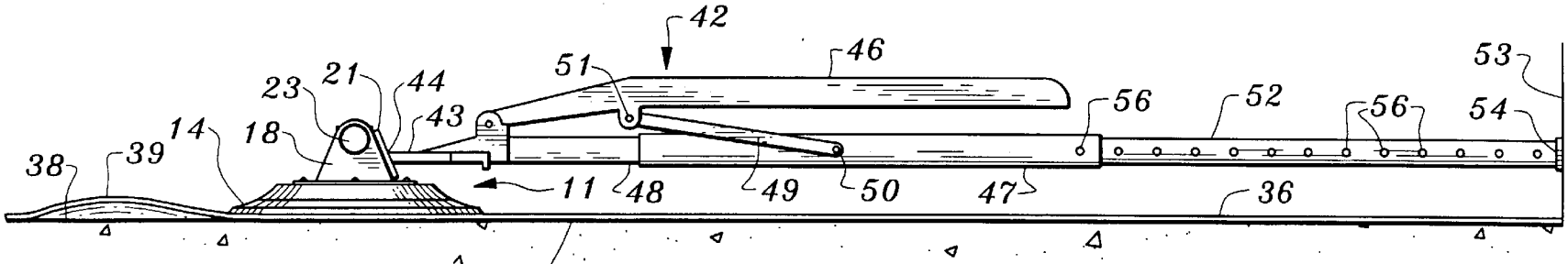
FIG. 13 is a view similar to FIG. 12 showing the flooring sheet in a stretched position after the jack is actuated.

The toggle jack 42 comprises a main cylinder 47 which by telescoping receives a jacking cylinder 48 welded or brazed to jack head 43. A pair of toggle links 49 each have one end pivoted to main cylinder 47 at 50 and another end pivoted to handle 46 at 51. By raising the handle 46 as shown in FIG. 12 jacking cylinder 48 is telescoped within the main cylinder 47 and the jack head 43 is withdrawn placing the jack 42 in a loaded position. FIG. 13 shows the toggle jack 42 after it has completed a power stroke. Lowering handle 46 causes it to pivot around pivots 51 acting as a fulcrum with increased leverage supplied by the toggle links 49 to force the jacking cylinder 48 and jack head 43 into an extended position. In other words, jacking cylinder 48 elongates out of main cylinder 47, effectively lengthening the distance from plate 54 to the suction cup 14.

The toggle jack modification of the invention is designed to operate in a unidirectional stretching mode and the reaction force is absorbed by a tail section 52 acting between main cylinder 47 and any convenient back stop or reaction surface such as a wall 53. As shown on the drawings, the tail section 52 is tubular with a series of through holes telescopically received within main cylinder 47. An indexing hole 56 is located near the end of the main cylinder. The tail section 52 is adjusted by inserting a nail, pin, or via a biased release (like button 33 in FIG. 5) through indexing hole 56 and one of the through holes in tail section 52 representing the desired length. A plate 54 is provided at the end of tail piece 52 to abut the wall 53 or other back stop.

An important feature of the invention is the ability to adapt the above flooring stretcher to large room installations. For this purpose, additional sections of tail pipes can be inserted between main cylinder 47 and tail piece 52 with attached stop plate 54. A simple sleeve coupling may be used to join the tail piece 52.

In use, as shown in FIGS. 12 and 13, after a flooring sheet 36 is cut and placed on a substrate 37 covered with adhesive 38 or tack strip 71, a ripple 39 may develop which needs to be removed. The toggle jack 42 is set up with the vacuum head 11 mounted forward of the ripple 39 and the tapered drive 44 inserted in opening 22 of pusher plate 21. The toggle handle 46 is set for the loaded position shown in FIG. 12 and the tail piece 52 adjusted to abut wall 53. The pump piston 23 is then pumped to develop maximum suction in suction cup 14 to firmly grip the flooring sheet 36. Handle 46 is then gradually pumped to move the head 11 forward to remove ripple 39. As shown in FIG. 13, the rear ripple 39 has been removed possibly forming a new one forward of the head 11. In this case the process is repeated.

The vacuum stretch tool disclosed above is unique in the sheet floor covering installing art and one hallmark of its operation is the ability of the pump-operated head to develop a strong grip on the vinyl.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A tool for applying flooring configured as non-textile sheet goods, comprising in combination:

a resilient vacuum suction means placed on the flooring for evacuating air from said vacuum suction means, thereby fastening by flattening said vacuum suction means onto the flooring;

an arm having first and second ends, said first end coupled to said vacuum suction means, extending above the flooring and spaced therefrom;

a pad affixed to said second end whereby the flooring is conformably deployed by moving the flooring in a plane parallel and in tangential registry to an underlying substrate by applying force parallel to the substrate through said pad.

2. The tool of claim 1 further comprising a vacuum release valve coupled to said vacuum suction means for exhausting the evacuated air between said vacuum suction means and the flooring.

3. The tool of claim 2 wherein said vacuum suction means is a circular suction cup, having inner and outer surfaces, said inner surface concave with respect to the flooring, and wherein said vacuum suction means includes an air pump mounted atop said outer surface.

4. The tool of claim 3 wherein said pump is a manually operable pump.

5. The tool of claim 4 further comprising a supporting bracket coupled between said vacuum suction means and said arm first end.

6. The tool of claim 5 further comprising a pusher plate coupled between said support bracket and said arm first end.

7. The tool of claim 6 further comprising a filter coupled between said vacuum suction means and said vacuum release valve.

8. The tool of claim 7 wherein said arm contains extension means for extending and retracting said arm.

9. The tool of claim 8 wherein said extension means includes a track adapted to said arm first end and a complimentarily formed tube adapted to said arm second end to complimentarily receive said track, said tube having a pawl for engaging said track, biasing means between said pawl and a rod, and a trigger coupled to said arm second end for pushing and releasing said rod, said bias means, and said pawl.

10. The tool of claim 9 wherein said supporting bracket comprises a pair of upstanding angled ears, a cross-tube secured to upper portions of said ears, a vacuum pump mounted in said cross tube, and said pusher plate being integrally bonded to said angled ears.

11. The tool of claim 10 wherein clamping pressure between the suction cup and vinyl sheet is determined by the extent of air evacuation by said pump, and wherein said vacuum release valve is a finger operated valve on said bracket to break the vacuum.

12. A device for removing surface anomalies in non-textile sheet flooring comprising, in combination:

resilient suction means including an air chamber removably engageable to said sheet flooring by deformation of said resilient suction means, changing air chamber volume; and kicker means for urging said suction means to smooth said anomalies connected to said suction means via an interposed arm.

13. The combination of claim 12 wherein said suction means comprises a vacuum pump operated suction cup to change chamber air volume.

14. A tool for stretching flooring, comprising, in combination:

a suction cup;

means to activate and release said suction cup; and means to apply a force to said suction cup parallel to the flooring;

wherein said force application means includes an arm coupled between said suction cup and a kickpad.

15. The tool of claim 13 wherein said activation means includes a vacuum pump.

16. The tool of claim 15 wherein said vacuum pump is hand operable.

17. The tool of claim 16 further comprising a vacuum release valve coupled to said vacuum pump.

18. The tool of claim 17 further comprising a support bracket coupled between said vacuum pump and said arm.

19. The tool of claim 18 further comprising a mounting plate coupled between said support bracket and said arm.

20. The tool of claim 15 wherein said release means includes a vacuum release valve.

21. The tool of claim 20 further comprising a filter coupled between said vacuum pump and said vacuum release valve.

22. The tool of claim 14 further comprising arm extension means coupled to said arm for extending and retracting said arm to predetermined positions.

23. The tool of claim 22 wherein said arm extension means includes:

a tongue and groove track within said arm;

a pawl engaged by said track tongue and groove;

an indexing trigger coupled to said arm; and a rod within said arm biased between said pawl and said indexing trigger.

24. A tool for applying flooring configured as sheet goods, comprising in combination:

a vacuum suction means overlying the flooring for evacuating air between said vacuum suction means and the flooring;

an arm having first and second ends, said first end coupled to said vacuum suction means, extending substantially parallel to the flooring;

a pad affixed to said second end whereby the flooring is conformably deployed by moving the flooring in a plane parallel in tangential registry to an underlying substrate by applying force through said pad also parallel to the substrate;

a supporting bracket coupled between said vacuum suction means and said arm first end; and a pusher plate coupled between said support bracket and said arm first end.

25. A tool for applying flooring configured as sheet goods, comprising in combination:

a vacuum suction means overlying the flooring for evacuating air between said vacuum suction means and the flooring;

an arm having first and second ends, said first end coupled to said vacuum suction means, extending substantially parallel to the flooring;

a pad affixed to said second end whereby the flooring is conformably deployed by moving the flooring in a plane parallel in tangential registry to an underlying substrate by applying force through said pad also parallel to the substrate;

a vacuum release valve coupled to said vacuum suction means for exhausting the evacuated air between said vacuum suction means and the flooring;

wherein said vacuum suction means is a circular suction cup, having inner and outer surfaces, said inner surface concave with respect to the flooring, and wherein said vacuum suction means includes an air pump mounted atop said outer surface;

wherein said pump is a manually operable pump;

a supporting bracket coupled between said vacuum suction means and said arm first end; and a pusher plate coupled between said support bracket and said arm first end.

26. A tool for applying flooring configured as sheet goods, comprising in combination:

a vacuum suction means overlying the flooring for evacuating air between said vacuum suction means and the flooring;

an arm having first and second ends, said first end coupled to said vacuum suction means, extending substantially parallel to the flooring;

a pad affixed to said second end whereby the flooring is conformably deployed by moving the flooring in a plane parallel in tangential registry to an underlying substrate by applying force through said pad also parallel to the substrate;

wherein said arm contains extension means for extending and retracting said arm;

wherein said extension means includes a track adapted to said arm first end and a complimentarily formed tube adapted to said arm second end to complimentarily receive said track, said tube having a pawl for engaging said track, biasing means between said pawl and a rod, and a trigger coupled to said arm second end for pushing and releasing said rod, said bias means, and said pawl.

* * * * *